US005718024A

United States Patent [19]

Robbins

[11] Patent Number: 5,718,024

[45] Date of Patent: Feb. 17, 1998

[54] CLOSURE ARRANGEMENT WITH TAPERED FLANGE

[75] Inventor: Todd L. Robbins, Scandinavia, Wis.

[73] Assignee: Reynolds Consumer Products, Inc., Appleton, Wis.

[21] Appl. No.: 596,534

[22] Filed: Feb. 5, 1996

[51] Int. Cl.[6] ..... B65D 33/24

[52] U.S. Cl. ..... 24/30.5 R; 24/587; 383/63

[58] Field of Search ..... 24/30.5 R, 587, 24/399, 400, 575, 576, 577; 383/63, 65, 68

[56] References Cited

U.S. PATENT DOCUMENTS 3,473,589 10/1969 Götz .
3,907,193 9/1975 Heller .
5,335,997 8/1994 Kanemitsu et al. .
5,358,334 10/1994 Simonsen .

FOREIGN PATENT DOCUMENTS 2221446 7/1990 United Kingdom .

*Primary Examiner*—James R. Brittain
*Attorney, Agent, or Firm*—Alan T. McDonald

[57] ABSTRACT

There is a need for a reclosable polymeric package which minimizes air leakage in the side seal area. This need is addressed by providing a unique closure arrangement for a polymeric bag where the closure arrangement is made up of two opposing closure profiles. These closure profiles are oriented so that they are each attached via their outer surfaces to the opposing films of the polymeric bag and are adapted to interlock with each other. The closure arrangement is further defined in that at least one of the closure profiles has a tapered lower flange. Preferably, the outer surface of the lower flange is tapered inwardly toward the inner surface of the lower flange. This can also be accomplished by tapering from the inner to outer surface.

22 Claims, 5 Drawing Sheets

CLOSURE ARRANGEMENT WITH TAPERED FLANGE

FIELD OF THE INVENTION

The present invention relates to a flexible polymeric package having a closure arrangement and, more particularly, relates to a package having an improved closure arrangement in which at least one of the opposing sides of the closure arrangement is tapered at one end so as to improve the sealing of the sides of the package in the area in contact with the closure arrangement.

BACKGROUND OF THE INVENTION

In many consumer applications it is desirable to provide a package which can be conveniently and effectively resealed after it has been initially opened. For example, when dealing with packaged foods, the consumer may initially use only a portion of the food contained in the package. By providing a package which may be reclosed, the consumer avoids having to locate a storage container for the unused portion of the food in the package. It will be appreciated that reclosable packaging appreciably enhances the marketability of such products.

A typical reclosable package is hermetically sealed by any suitable means, e.g., by a peel seal, a cut-off-top, or a combination of a peel seal and a perforation top, which protects the integrity of the package until the consumer initially opens the package. By also providing a way to reclose a package, the consumer may manually reseal the package after each use.

A common type of reclosable means may include a pressure fastenable seal in the form of a rib or male member located on one package wall and a mating groove or female member located on an opposing package wall. This reclosable means is frequently referred to as a zipper.

Closure arrangements such as zippers are typically incorporated into a polymeric package by heat sealing each opposing profile of the zipper to the package film so that the interlocking members of the closure arrangement face each other. Alternatively, an adhesive may be used to attach the closure flanges to the package film. Regardless of the method of sealing utilized, and because of the thickness of the closure flanges, an inadequate seal is oftentimes formed at the sides of the package (the side seal area) where the packaging film meets the ends of the closure flanges. Specifically, small air holes frequently form where the package film and closure flanges do not completely melt or otherwise adhere together. Air can easily get into the package through these holes resulting in food spoilage. Furthermore, liquid contents of the package can leak out. The thicker the closure flanges, the greater the potential for inadequate sealing.

A need therefore exists for a polymeric package with a closure arrangement incorporated therein which minimizes the potential for inadequate sealing and consequent air leakage in the side seal area.

SUMMARY OF THE INVENTION

The present invention addresses the need for a reclosable polymeric package which minimizes air leakage in the side seal area. This need is addressed by providing a unique closure arrangement for a polymeric bag in which the closure arrangement is made up of two opposing closure profiles. These closure profiles are oriented so that they are each attached to the opposing films of the polymeric bag and are adapted to interlock with each other. The closure arrangement is further defined in that at least one of the closure profiles has a tapered lower flange. Preferably, the outer surface of the lower flange is tapered inwardly toward the inner surface of the lower flange. Alternatively, the inner surface of the lower flange may be tapered toward the outer surface of the lower flange.

In an especially preferred embodiment, both closure flanges have tapered lower flanges which are offset from each other at their lowermost ends.

BRIEF DESCRIPTION OF THE DRAWINGS

Other objects and advantages of the invention will become apparent upon reading the following detailed description and upon reference to the drawings in which.

Figure 1:
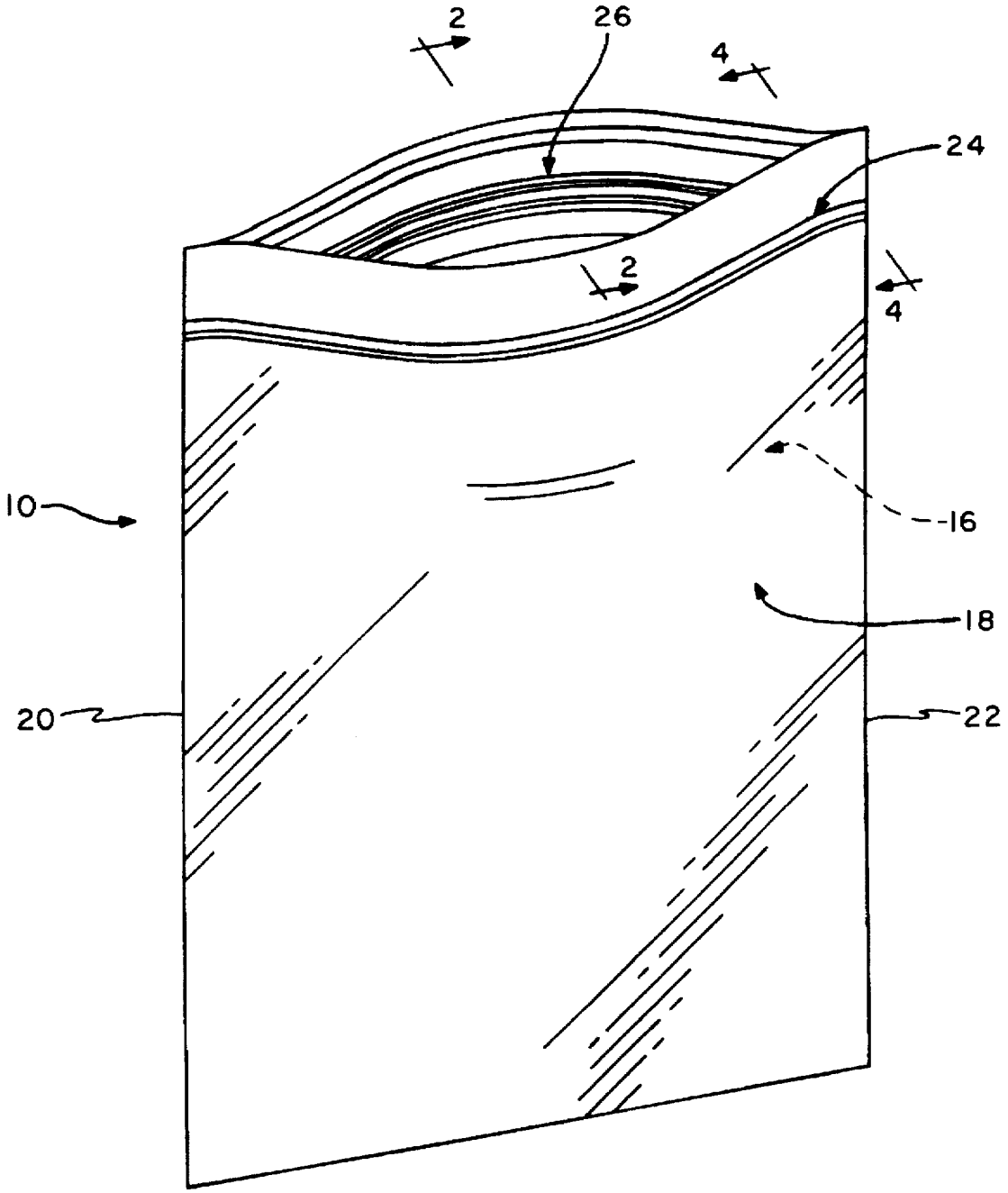
FIG. 1 is a perspective view of a reclosable polymeric package.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DESCRIPTION OF THE PREFERRED EMBODIMENTS

Turning now to the drawings, FIG. 1 illustrates a perspective view of a reclosable polymeric bag 10 incorporating male and female closure profiles 24, 26 and opposing polymeric films 16, 18. The opposing polymeric films 16, 18 are sealed together at the sides 20, 22 of the bag 10.

Figure 2:
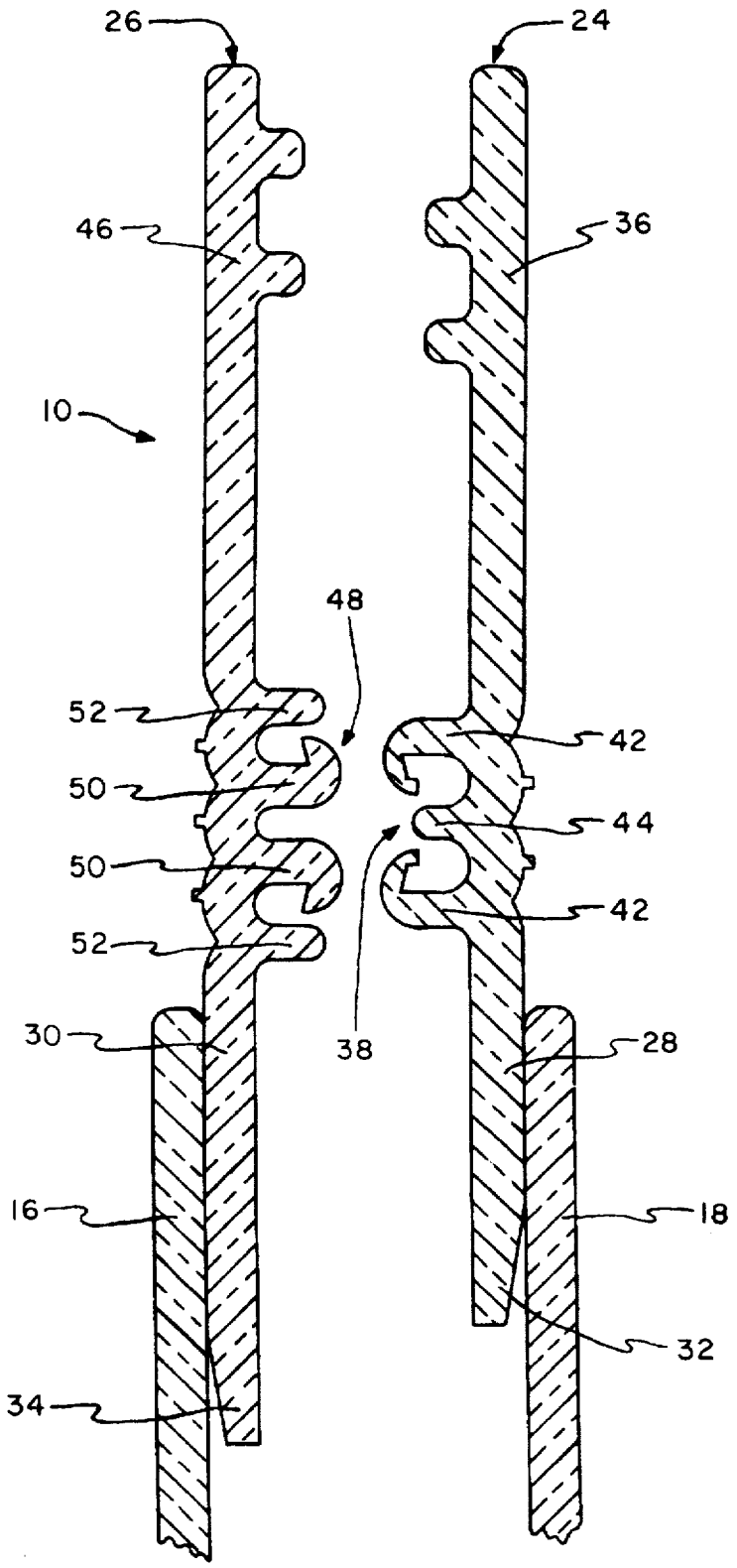
FIG. 2 is a cross-sectional view taken generally along line 2—2 in FIG. 1.

FIG. 2 illustrates a cross-sectional view of the reclosable polymeric package 10 that has been cut approximately though the middle. The reclosable polymeric package 10 incorporates a male closure profile 24 including a base strip 36 and a male closure member 38 and a female closure profile 26 including a base strip 46 and a female closure member 48. The respective base strips 36, 46 of the male and female closure profiles 24, 26 include respective lower flanges 28, 30 having respective lower portions 32, 34 wherein the lower portion 32 of the lower flange 28 of the male closure profile 24 is vertically offset with respect to the lower portion 34 of the lower flange 30 of the female closure profile 26. The staggering of the lower portions 32, 34 of the respective lower flanges 28, 30 further reduces the thickness of the closure arrangement at the side seal area. This reduced profile thickness reduces the possibility of leaks at the sides 20, 22 of the bag 10 in FIG. 1 in the area of the closure profiles 24, 26 by reducing the thickness that the opposing polymeric films 16, 18 must be stretched to be sealed together.

To provide the polymeric package 10 with a reclosable closure arrangement, the male closure profile 24 and the female closure profile 26 are designed to releasably interlock. Specifically, the male closure profile 24 includes the male closure member 38 which extends from the inner surface of base strip 36 and includes a pair of flexible locking arms 42 (male flexible locking arms) and a protruding post 44 located between the arms 42. The female closure profile 26 includes the female closure member 48 which extends inwardly from the base strip 46 and also includes a pair of flexible locking arms 50 (female flexible locking arms) with hooks at the ends thereof designed to lock with the male flexible locking arms 42 of the male closure member 38.

The male flexible locking arms 42 are disposed opposite the female flexible locking arms 50 and are spaced with respect to each other by a sufficient distance such that they are releasably engageable with the female flexible locking arms 50. To facilitate alignment of the pair of male flexible locking arms 42 with the pair of female flexible locking arms 50 during reclosure, the female closure profile 26 is provided with a pair of guide posts 52 for guiding the two pairs of locking arms 42, 50 together.

The respective base strips 36, 46 of the male and female closure profiles 24, 26 include the respective lower flanges 28, 30 which include the tapered lower portions 32, 34, respectively. The outer surfaces of the tapered lower portions 32, 34 taper inwardly toward the respective inner surfaces of the tapered lower portions 32, 34. The tapered lower portions 32, 34 of the respective lower flanges 28, 30 are approximately 7–10 percent of the entire vertical height of the lower flanges 28, 30.

Figure 3:
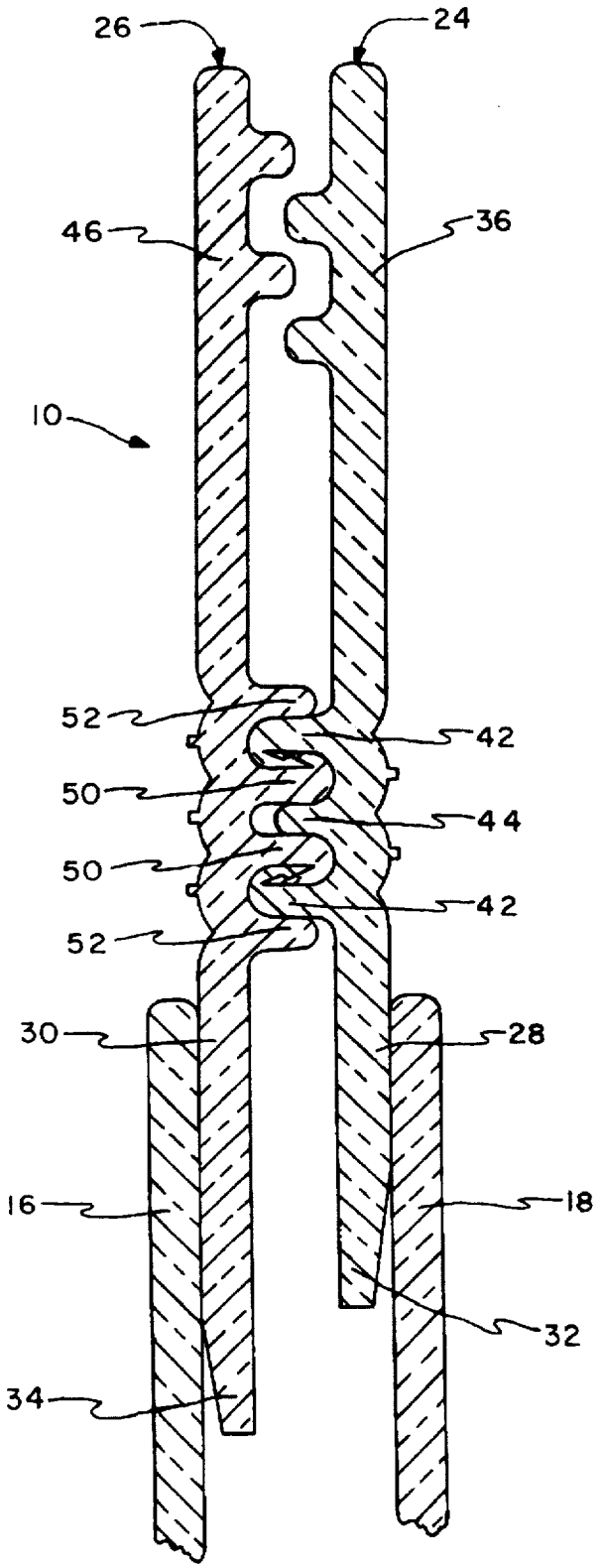
FIG. 3 is a cross-sectional view similar to that shown in FIG. 2 except that the male and female closure profiles are interlocked.

FIG. 3 illustrates a cross-sectional view similar to that shown in FIG. 2 except that it shows the male and female closure profiles 24, 26 interlocked with each other.

Figure 4:
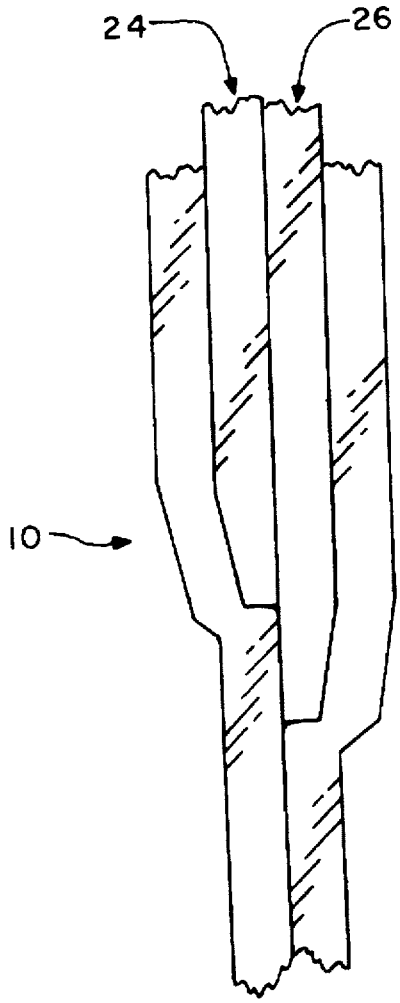
FIG. 4 is a magnified cross-sectional view taken generally along line 4—4 in FIG. 1.

FIG. 4 illustrates a magnified cross-sectional view taken in close proximity to the sides 20, 22 of the bag 10 in FIG. 1. Specifically, the tapered lower portions 32, 34 of the respective lower flanges 28, 30 of the respective closure profiles 24, 26 are magnified. As can be seen, the taper of the lower portions 32, 34 of the respective lower flanges 28, 30 reduces the profile thickness at the lowermost ends of the closure profiles 24, 26. This reduced profile thickness reduces the possibility of leaks in the finished package 10 in FIG. 1 by allowing the opposing polymeric films 16, 18 to come closer together at the sides 20, 22 of the bag in the area which is in contact with the closure profiles 24, 26 during the sealing process.

Figure 5:
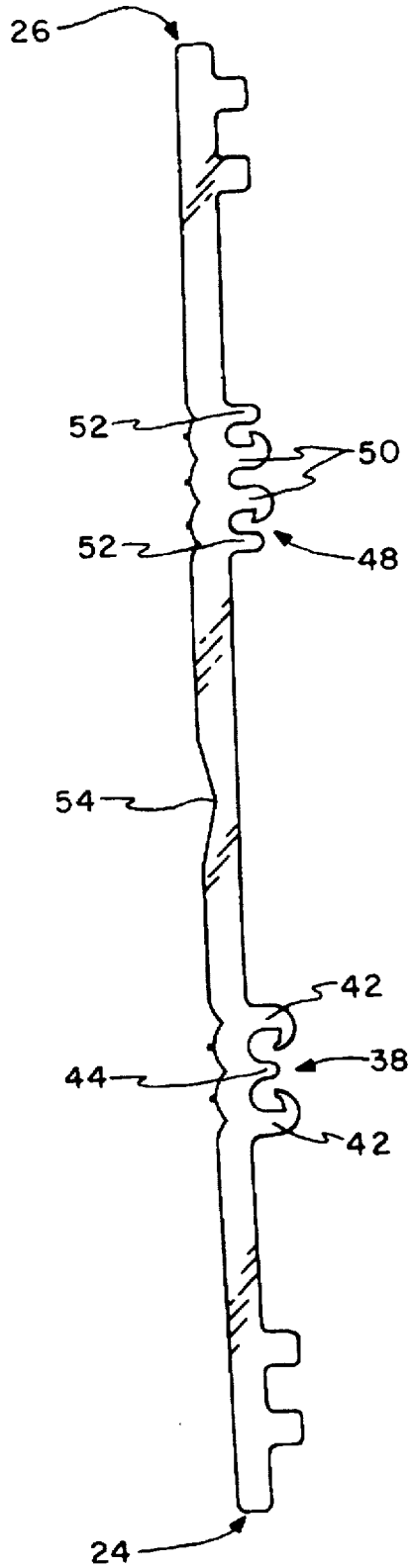
FIG. 5 is a cross-sectional view of a polymeric web incorporating both male and female closure profiles prior to their separation and incorporation into individual packages.

In addition to reducing the closure arrangement thickness in the side seal area, tapering of the respective lower portions 32, 34 of the lower flanges 28, 30 facilitates ease of cut-off during the manufacturing process. This concept can be better understood by turning to FIG. 5. Specifically, when both male and female closure profile webs 24, 26 are extruded together and then later slit to create two separate webs, a reduced profile thickness in the cut off area 54 will facilitate an easier separation when the individual profiles are cut apart.

It should be apparent that when the male and female closure profiles are co-extruded, there is an upper limit to the percentage of taper that can exist between the uppermost and lowermost ends of the tapered lower portions of the lower flanges. A taper or reduction of thickness so that the lowermost portion of the tapered lower portion is approximately 60 percent of the thickness of the uppermost portion is particularly preferred. In an especially preferred embodiment, the uppermost ends of the tapered lower portions of the lower flanges have a thickness of approximately 4–6 mils and the lowermost ends have a thickness of approximately 2.5–3.0 mils. When the male and female closure profiles are separately extruded, as opposed to being extruded together on a single web as in FIG. 5, the percentage taper or reduction of thickness between the uppermost and lowermost portions of the lower flanges can approach 100 percent. The taper along the outer surfaces of the tapered lower portions can be planar or curved in all of the described embodiments.

It should be understood that the present invention can be used in polymeric packages which incorporate closure members different from those depicted in FIGS. 2, 3, 5 and 6. For instance, a male closure member may consist of a single locking arm and the corresponding female closure member may consist of a single pair of locking arms. Additionally, closure means other than interlocking male and female closure profiles may be utilized. Specifically, closure means including, but not limited to, tear beads and peel seals will work equally well in the present invention. In effect, a polymeric package which incorporates any of a variety of types of closure means which must be affixed to a base strip or profile will exhibit improved sealing in the side seal area if the base strip or profile is tapered.

In a prototypical flexible polymeric package, the male and female closure profiles 24, 26, including respective base strips 36, 46 and respective closure members 38, 48, and the polymeric films 16, 18 consist essentially of a heat resistant low density or linear low density polyethylene blend material. The polyethylene blends may also contain small percentages of polypropylene or ethylene vinyl acetate.

The closure arrangements and polymeric packages are manufactured using conventional extrusion and heat sealing techniques. In particular, the base strips 36, 46 and the closure members 38, 48 are co-extruded through a die plate fed by one or more extruders. As is well-known in the art, the die plate is configured to shape the molten materials into the base strips and the closure members. The output ports of the die plate are arranged such that the base strips and the closure members exit the die plate with the illustrated connections. Since base strip 36 and the female closure member 38 are separated from base strip 46 and the male closure member 48, it should be apparent that these two separate sets of elements may be formed in separate extrusions using two separate die slots.

After extruding the base strips and the closure members, the top and bottom films making up the polymeric bag are thermally fused to the respective base strips. An intermediary adhesive may be used to facilitate sealing the base strips to the polymeric packaging film.

Figure 6:
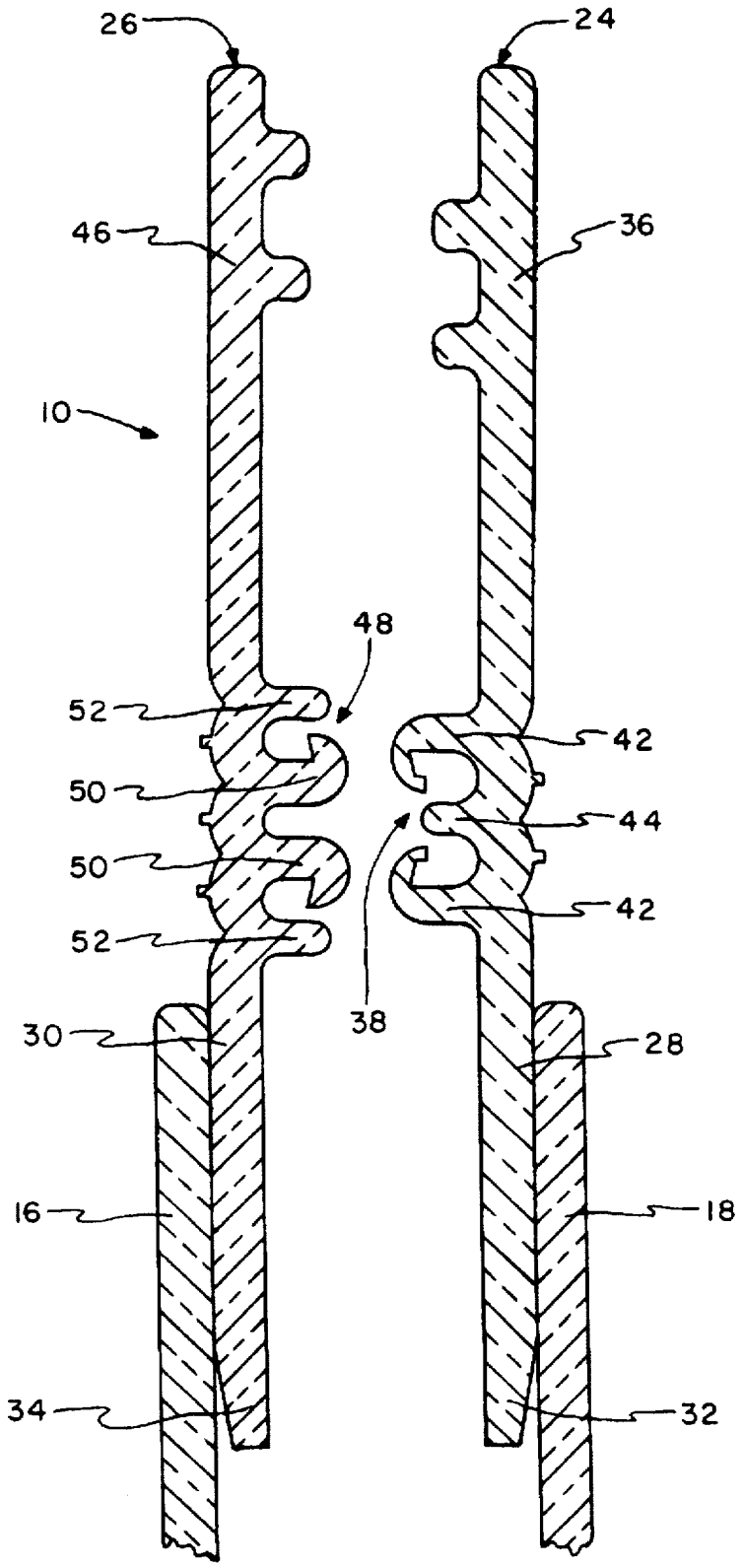
FIG. 6 is a cross-sectional view of a closure arrangement for a reclosable polymeric package that is similar to FIG. 2 except that the lowermost ends of the tapered lower flanges are not vertically offset with respect to each other.

While the present invention has been described with reference to one or more particular embodiments, those skilled in the art will recognize that many changes may be made thereto without departing from the spirit and scope of the present invention. For example, as shown in FIG. 6, the present invention also contemplates a reclosable polymeric package 10 including closure profiles 24, 26 in which the respective tapered lower portions 32, 34 of the respective lower flanges 28, 30 are not vertically offset with respect to each other. Each of these embodiments and obvious variations thereof is contemplated as falling within the spirit and scope of the claimed invention, which is set forth in the following claims.

What is claimed is:

1. A closure arrangement in combination with a polymeric bag, said bag having first and second opposing films, said closure arrangement comprising:

a first closure profile attached to an inner surface of the first film, said first closure profile including a first lower flange, said first lower flange including a tapered first lower portion having inner and outer surfaces and a first untapered upper portion having inner and outer surfaces and attached to said tapered first lower portion at a first junction, said outer surface of said tapered first lower portion tapering inwardly toward said inner surface of said tapered first lower portion, said outer surface of said tapered first lower portion being unattached to the first film and said outer surface of said first untapered upper portion being attached to the inner surface of the first film for a length extending from said first junction with said first tapered lower portion; and a second closure profile attached to an inner surface of the second film and adapted to interlock with said first closure profile.

2. The closure arrangement of claim 1, wherein said second closure profile includes a second lower flange, said second lower flange including a tapered second lower portion having inner and outer surfaces and a second untapered upper portion having inner and outer surfaces and attached to said second tapered lower portion at a second junction, said outer surface of said tapered second lower portion tapering inwardly toward said inner surface of said tapered second lower portion, said outer surface of said tapered second lower portion being unattached to the second film and said outer surface of said second untapered upper portion being attached to the inner surface of the second film for a length extending from said second junction with said second tapered lower portion.

3. The closure arrangement of claim 2, wherein a lowermost end of said first tapered lower portion is offset a predetermined distance from a lowermost end of said second tapered lower portion.

4. The closure arrangement of claim 2, wherein a lowermost end of said tapered first lower portion is in close proximity to an uppermost end of said tapered second lower portion.

5. The closure arrangement of claim 2, wherein a lowermost end of each of said tapered first and second lower portions is tapered to between approximately 0 and 60 percent of the thickness of an uppermost end of each of said tapered first and second lower portions.

6. The closure arrangement of claim 5, wherein the thickness of said uppermost end of each of said first and second tapered lower portions is approximately four to six mils and the thickness of said lowermost end of each of said first and second tapered lower portions is approximately two and one half to three mils.

7. The closure arrangement of claim 2, wherein a lowermost end of each of said tapered first and second lower portions is tapered to approximately 60 percent of the thickness of an uppermost end of each of said tapered first and second lower portions.

8. The closure arrangement of claim 2, wherein said inner surfaces of said tapered first and second lower portions are planar.

9. The closure arrangement of claim 2, wherein said inner surfaces of said tapered first and second lower portions are curved inwardly toward said outer surfaces of said respective tapered first and second lower portions.

10. The closure arrangement of claim 1, wherein said first closure profile includes a first base and one or more first closure members integrally formed with said first base, said first base including said first lower flange, and wherein said second closure profile includes a second base and one or more second closure members integrally formed with said second base, said first closure member or members being adapted to interlock with said second closure member or members.

11. The closure arrangement of claim 10, wherein said second closure profile further includes a second lower flange, said second lower flange including a second tapered lower portion having inner and outer surfaces and a second untapered upper portion having inner and outer surfaces and attached to said second tapered lower portion at a second junction, said outer surface of said second tapered lower portion tapering inwardly toward said inner surface of said second tapered lower portion, said outer surface of said tapered second lower portion being unattached to the second film and said outer surface of said second untapered upper portion being attached to the inner surface of the second film for a length extending from said second junction with said second tapered lower portion.

12. The closure arrangement of claim 11, wherein a lowermost end of said first tapered lower portion is offset a predetermined distance from a lowermost end of said second tapered lower portion.

13. The closure arrangement of claim 11, wherein a lowermost end of said tapered first lower portion is in close proximity to an uppermost end of said tapered second lower portion.

14. The closure arrangement of claim 11, wherein a lowermost end of each of said tapered first and second lower portions is tapered to between approximately 0 and 60 percent of the thickness of an uppermost end of each of said tapered first and second lower portions.

15. The closure arrangement of claim 11, wherein a lowermost end of each of said tapered first and second lower portions is tapered to approximately 60 percent of the thickness of an uppermost end of each of said tapered first and second lower portions.

16. A closure arrangement in combination with a polymeric bag, said bag having first and second opposing films, said closure arrangement comprising:

first closure means attached to an inner surface of the first film, said first closure means including a tapered first lower portion having inner and outer surfaces and an untapered first upper portion having inner and outer surfaces and attached to said tapered first lower portion at a first junction, said outer surface of said tapered first lower portion tapering inwardly toward said inner surface of said tapered first lower portion, said outer surface of said tapered first lower portion being unattached to the first film and said outer surface of said untapered first upper portion being attached to the inner surface of the first film for a length extending from said first junction with said tapered first lower portion.

17. The closure arrangement of claim 16, further including second closure means attached to an inner surface of the second film and adapted to interlock with said first closure profile.

18. The closure arrangement of claim 17 wherein said second closure profile includes a second lower flange, said second lower flange including a tapered second lower portion having inner and outer surfaces and an untapered second upper portion having inner and outer surfaces and attached to said tapered second lower portion at a second junction, said outer surface of said tapered second lower portion tapering inwardly toward said inner surface of said tapered second lower portion, said outer surface of said tapered second lower portion being unattached to the second film and said outer surface of said untapered second upper portion being attached to the inner surface of the second film for a length extending from said second junction with said tapered second lower portion.

19. The closure arrangement of claim 18, wherein a lowermost end of said first tapered lower portion is offset a predetermined distance from a lowermost end of said second tapered lower portion.

20. The closure arrangement of claim 18, wherein a lowermost end of said tapered first lower portion is in close proximity to an uppermost end of said tapered second lower portion.

21. The closure arrangement of claim 18, wherein a lowermost end of each of said tapered first and second lower portions is tapered to between approximately 0 and 60 percent of the thickness of an uppermost end of each of said tapered first and second lower portions.

22. The closure arrangement of claim 18, wherein a lowermost end of each of said tapered first and second lower portions is tapered to approximately 60 percent of the thickness of an uppermost end of each of said tapered first and second lower portions.

* * * * *